US005699940A

United States Patent [19]

Clark, II

[11] Patent Number: 5,699,940

[45] Date of Patent: Dec. 23, 1997

[54] DEVICE FOR REMOVING FLUID FROM A CONTAINER WITH PRESSURIZED AIR AND THEREAFTER PLACING THE CONTAINER UNDER VACUUM

[75] Inventor: James E. Clark, II, Ojai, Calif.

[73] Assignee: C.H. & I. Technologies, Inc., Santa Paula, Calif.

[21] Appl. No.: 676,568

[22] Filed: Jul. 8, 1996

[51] Int. Cl.[6] ..... B65D 83/00

[52] U.S. Cl. ..... 222/394; 141/65; 141/67; 141/94

[58] Field of Search ..... 222/159, 53, 394, 222/400.7; 141/65, 67, 94, 66

[56] References Cited

U.S. PATENT DOCUMENTS

| | | | |
|---|---|---|---|
| 2,972,342 | 2/1961 | Owen | 222/159 X |
| 5,234,037 | 8/1993 | Derby | 141/67 |
| 5,437,202 | 8/1995 | Clark, II | 222/394 X |
| 5,450,881 | 9/1995 | Patterson | 141/66 X |
| 5,560,407 | 10/1996 | Swinford | 141/65 X |

*Primary Examiner*—Gregory L. Huson

*Attorney, Agent, or Firm*—Daniel R. Kimbell

[57] ABSTRACT

A device to empty fluid from a sealed pressure container by use of pressurized air, and thereafter to place the container under vacuum. The device has a sleeve portion which defines an interior chamber. A ring portion with a hole extends into the interior chamber and forms a seating surface. A slidable seat with an aperture is located in the interior chamber below the ring portion and is sized to loosely fit in the interior chamber and seat on the ring portion. An upper cap with an air channel is located at the upper end of the sleeve and a lower cap with an air channel is placed at the lower end of the sleeve portion. A spring placed in the interior chamber between the lower cap and the slidable seat biases the slidable seat into contact with the ring portion. A floatable ball is placed above the slidable seat and is adapted to fluid tightly seat on and seal off its aperture. The floatable ball is sized to freely pass through the hole in the ring portion. A vacuum generator is also provided. It has a flow-through channel, a junction air channel in communication with the flow-through channel at an upper end and in communication with the channel in the upper cap, and an air flow valve with opened and closed positions located downstream of the junction of the air channel.

7 Claims, 3 Drawing Sheets

DEVICE FOR REMOVING FLUID FROM A CONTAINER WITH PRESSURIZED AIR AND THEREAFTER PLACING THE CONTAINER UNDER VACUUM

BACKGROUND OF THE INVENTION

1. Field of the Invention

The invention relates to the art of preparing containers for reuse, and more particularly to a device to both propel fluid out of a container by air pressure and thereafter place the container under vacuum.

2. State of the Prior Art

The ability to easily and quickly prepare pressure containers filled with fluid for reuse by both emptying the container of fluid and also placing the container under a vacuum is important in many fields, such as in the lubricant field. There have been devices developed to take samples of fluid from a pressure container without excessive loss of vacuum in the container, such as the inventor's U.S. Pat. No. 5,437,202. However, as far as the inventor knows, there is no single device designed to both evacuate a fluid from a container by use of pressurized air to force the fluid from the container, and thereafter also place a vacuum on the container once it is emptied of the fluid for immediate reuse in collecting fluid. In the case of fluids such as used motor oil and other industrial fluids, skin contact with the fluid is best avoided, as long term exposure is harmful. Therefore, a single, simple device which allows a used fluid container to be both emptied of the fluid and placed under vacuum would be highly useful.

BRIEF DESCRIPTION OF THE INVENTION

The invention provides a simple and reliable device which is used to propel fluid out of a sealed pressure container by use of pressurized air, and thereafter to place the pressure container under vacuum.

The invention further provides a device used in conjunction with a pressurized air source which in a first mode will force a fluid out of a sealed pressure container, and in a second mode will utilize the pressurized air source to place a vacuum on the sealed pressure container.

The invention further provides a device which can be detachably attached to a sealed pressure container which is used to pressurize fluid out of the sealed pressure container by use of pressurized air, and thereafter to place the container under vacuum.

DETAILED DESCRIPTION OF THE DRAWINGS

DETAILED DESCRIPTION OF THE INVENTION

Figure 1:
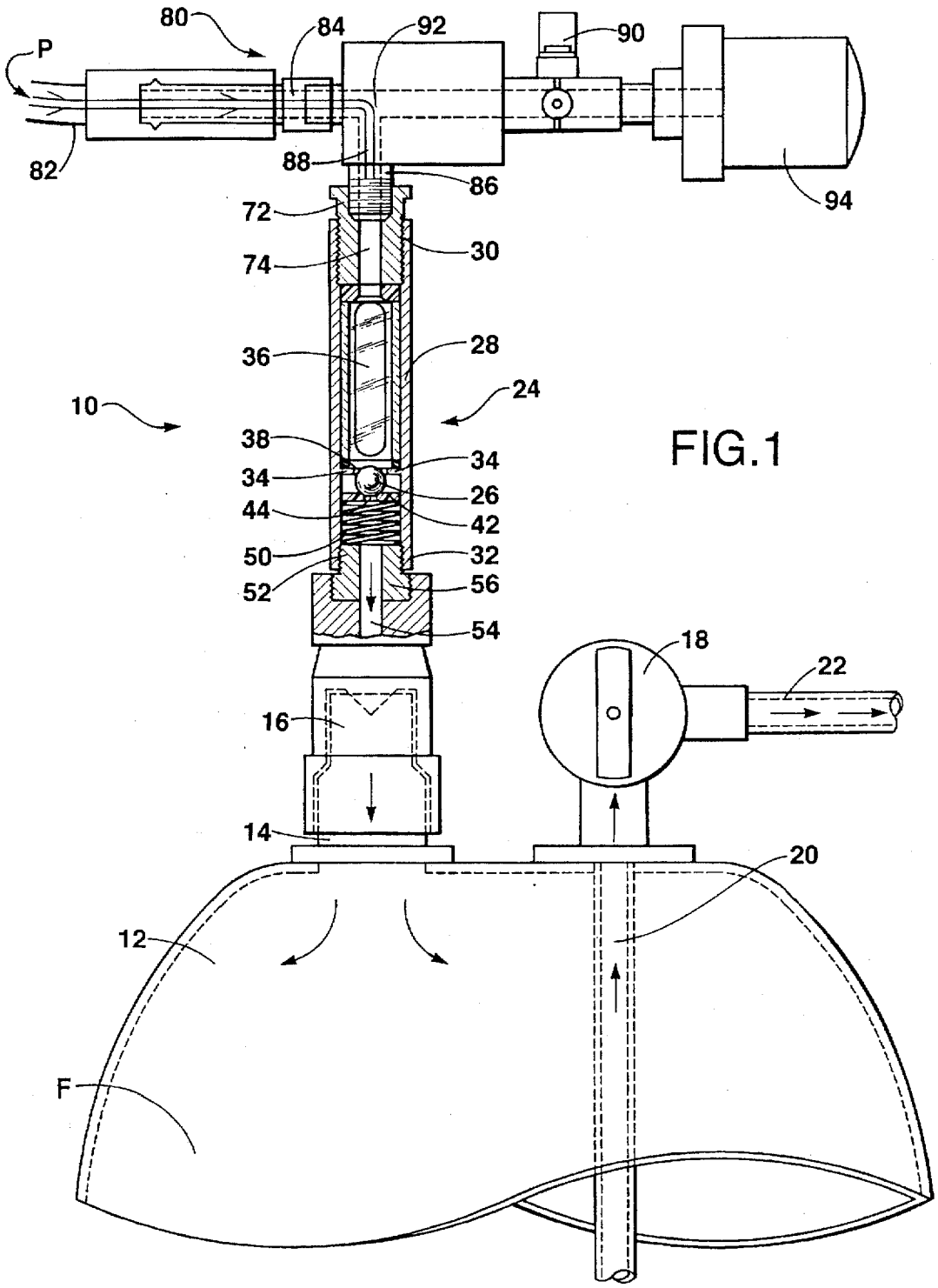
FIG. 1 is a perspective view showing the device of the invention attached to a pressure cylinder containing fluid, and in its mode to expel the fluid using air pressure.
Figure 2:
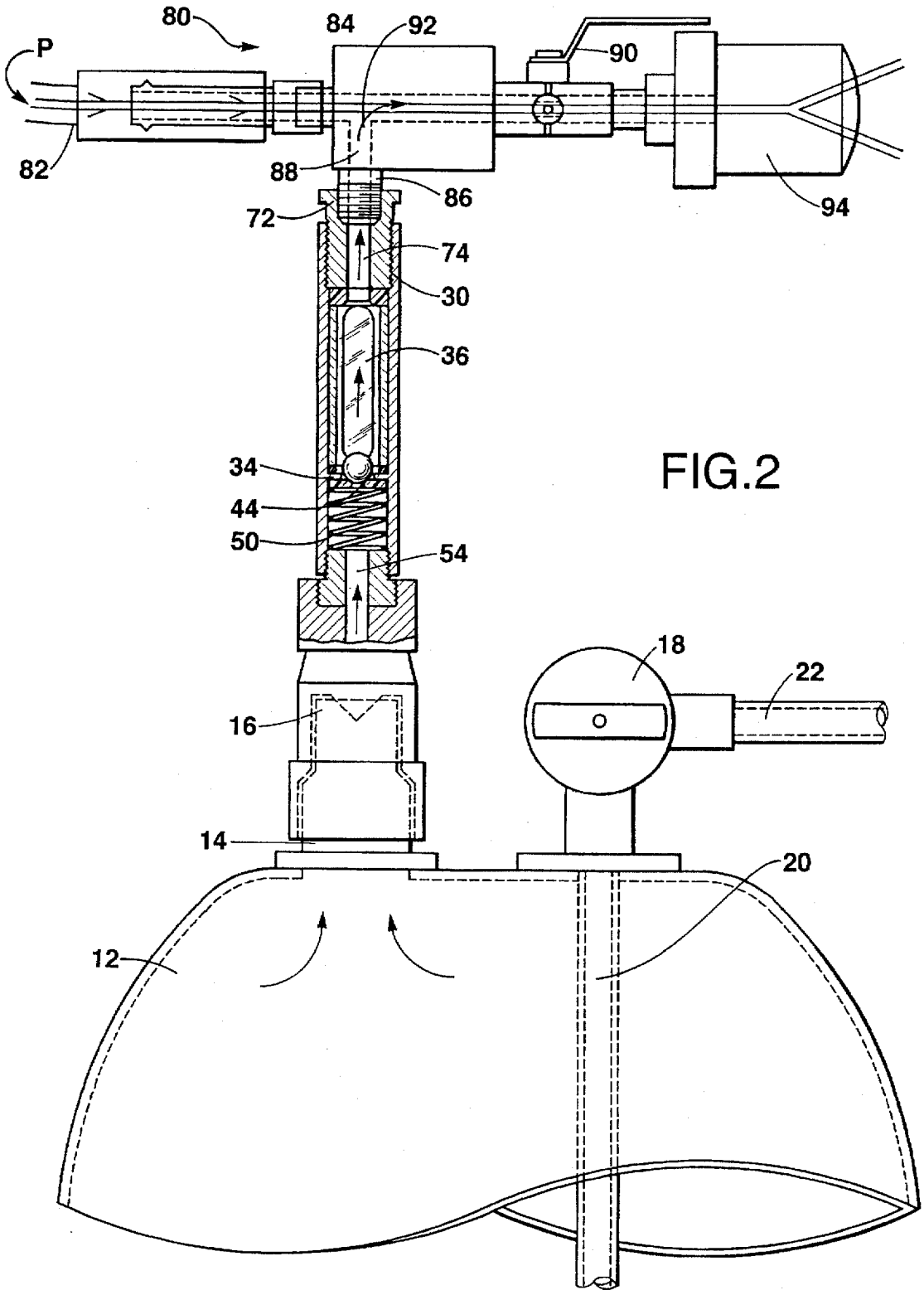
FIG. 2 is a perspective view showing the device of the invention attached to a pressure cylinder, after the fluid has been expelled, and its mode to place a vacuum on the cylinder..

Referring to FIGS. 1 and 2, the device 10 of the invention is shown attached to a pressure cylinder 12 containing fluid F therein. The pressure cylinder 12 preferably has a dry break hydraulic fitting 14 which allows the device 10 with a mating and complementary hydraulic fitting 16 to be quickly and fluid-tightly attached thereto. The pressure cylinder 12 is also fitted with a fluid valve 18 which has a feed tube 20 extending down into the cylinder 12 and an outlet tube 22. A pressure gauge (not shown), can also be fitted on the container 12.

Figure 3:
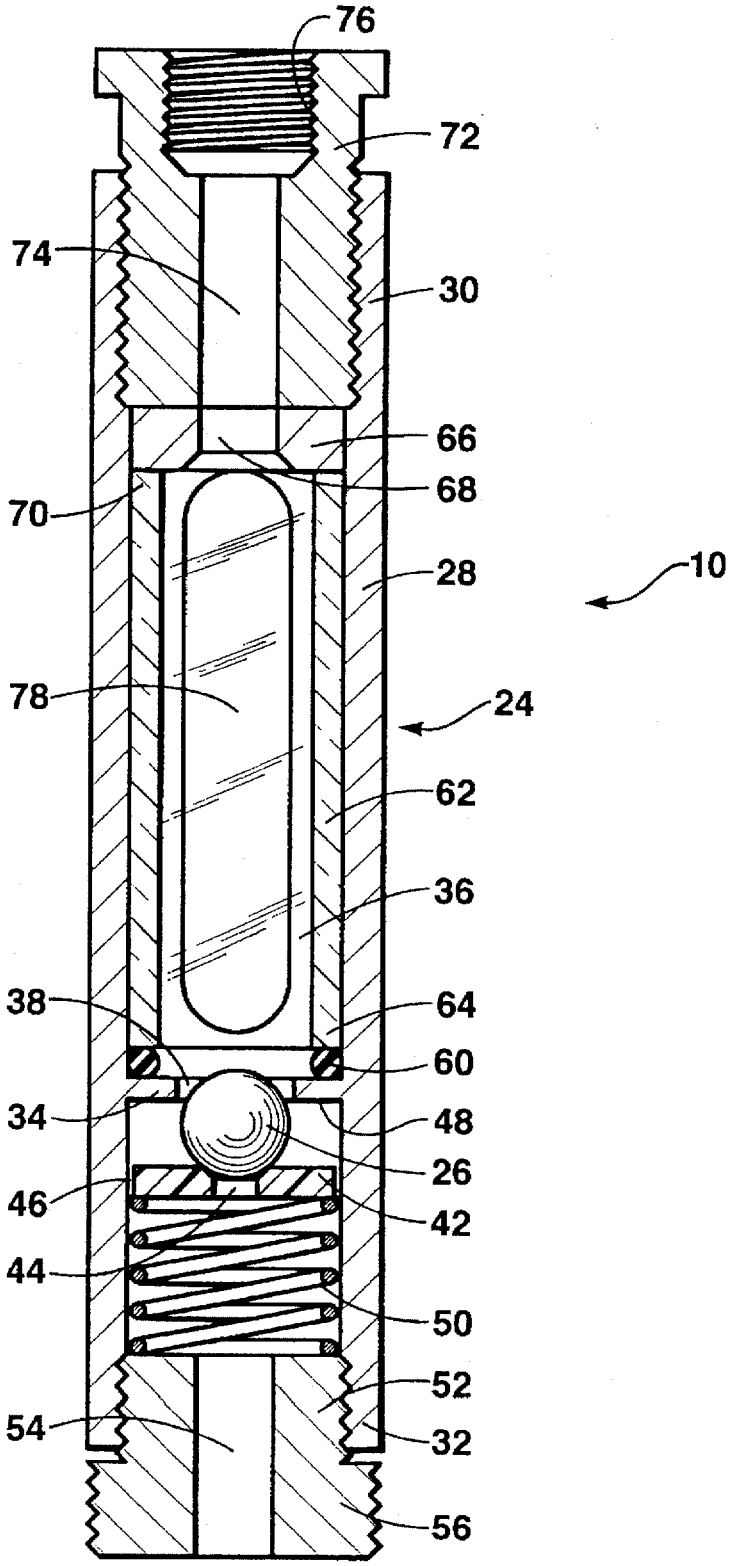
FIG. 3 is a detail front view showing the cylindrical chamber portion of the device.

Referring to FIGS. 1–3, the device 10 has a cylindrical chamber portion 24 with a check ball 26 placed inside. The cylindrical chamber portion 24 can conveniently comprise a metal or plastic sleeve 28 with an upper end 30 and a lower end 32. A seating ring portion 34 extends inwardly into the interior chamber 36. The seating ring portion 34 has an enlarged hole 38 formed therethrough. A floatable check ball 40 is located in the interior chamber 36, and normally will sit atop a slidable seat 42 which has an aperture 44 formed longitudinally therethrough. The floatable check ball 40 can comprise an aluminum ball, a hollow steel ball, or a plastic ball, and is designed to be capable of floating on fluid F. The slidable seat 42 is slightly smaller in diameter than the interior diameter of the interior chamber 36 below the seating ring portion 34, and is designed to allow fluid and air to pass along its outer perimeter edge 46 when it is displaced downwardly away from contact with the lower surface 48 of the ring portion 34, and forms a seal therewith. The slidable seat 42 is preferably formed of a relatively hard rubber or plastic material, which closely conforms to the ring portion 34. The floatable check ball 40 is sized to freely pass through the enlarged hole 38 in the seating ring portion 34, and the floatable check ball 40 is sized to fluid-tightly seat in the entrance to the aperture 44 in the slidable seat 42. A biasing coil spring 50 is placed in the interior chamber 36 below the slidable seat 42 and is held in place, biasing the slidable seat 42 upwardly into contact with the lower surface 48 of the ring portion 34, by a lower cap 52 with a longitudinal channel 54, as is best shown in FIG. 3. The lower end 56 of the lower cap 52 can be threaded for attachment to the hydraulic fitting 16, as shown in FIGS. 1 and 2. In a preferred embodiment, the lower cap 52 can be threaded to screw into the lower end 32 which is also threaded.

Referring particularly to FIG. 3, an O-ring 60 is placed on top of the seating ring portion 34 and fits snugly against the inside of the sleeve's walls 28. A clear tube 62 made of glass or other clear materials and sized to closely fit inside the sleeve 28 is placed into the sleeve and rests with its bottom edge 64 on the O-ring 60. A top seat 66 with a hole 68 formed longitudinally therethrough is placed inside the interior chamber 36 and contacts the inside of the interior chamber 36 and a top edge 70 of the clear tube 60. An upper cap 72 with a longitudinal channel 74 formed therethrough is attached to the top end 30 of the sleeve 28, and fluid tightly retains the clear tube 60 into place in the sleeve 62. In a preferred construction, the upper end 30 of the sleeve is threaded to receive the threaded upper cap 72. The upper region of the channel 74 can be female threaded 76. The upper region sleeve 28, which can be conveniently made of opaque materials such as aluminum, stainless steel, brass or other metals and/or certain plastics and resins, has a window 78 formed therein so that the position of the floating ball 40 in the interior chamber 36 can be readily seen. In an alternate construction, if the sleeve 28 is constructed of transparent material, the transparent tube 28 and the window 76 in the sleeve can be foregone with (not shown).

Referring again to FIGS. 1 and 2, a vacuum generator 80 is fitted in gaseous communication with the top of the device 10. Pressurized air "P" is supplied at an inlet end 82 of the vacuum generator 80 and passes through a flow-through channel 84. The pressurized air "P" can be supplied by a compressor and/or a reservoir tank (not shown). The vacuum generator 80 has a fitting 86 which is attachable (e.g. by threads) to the top of the upper cap 72 and is in gaseous communication with its channel 74 a junction air channel 88. An air flow valve. 90 is placed downstream of the junction 92 of the junction air channel 88 with the flow-through channel 84. The pressurized air flow P is expelled through an air exhaust muffler 94 which is located downstream of the air flow valve 90.

In FIG. 1, the air flow valve 90 is in its closed position to block the free flow of pressurized air P out of the muffler 92. Instead, the pressurized air P must flow down through the junction air channel 88, the channel 74 in the upper cap 72 and into the interior chamber 36. This pressure P will push the floatable ball downwardly into the entrance of the aperture 44 in the seat 42, and will bias the spring 50 downwardly, with the loose fit of the seat 42 allowing the air to pass through the space around its perimeter 46 and the inside walls of the sleeve 28. The air pressure will then pass through the channel 54 in the bottom cap 52, and into the pressure cylinder 12. By opening the fluid flow valve 18, the fluid F in the pressure cylinder will be pressurized and propelled up and out through the feed tube 20, through the open fluid valve 18 and out of the outlet tube 22. After the pressure cylinder 12 is emptied of fluid, the fluid flow valve 18 can be turned off. Preparing the pressure container 12 by placing it under a vacuum is then carried out, and is shown in FIG. 2.

In FIG. 2, the air flow valve 90 is moved to its open position to allow air flow to freely pass therethrough. In this position, the quickly moving pressurized air P through the flow-through channel 84 will create a low pressure zone by the venturi effect at junction 92 of the junction air channel 88 and the flow-through channel 84, and will cause air to be drawn upwardly through the device 10 and out of the pressure cylinder 12. In this mode, the slidable seat 42 will seat on the lower surface 48 of the ring portion 34, and the air will pass upwardly through the channel 54 in the lower cap 52, escape through the aperture 44 in the slidable seat 42 around the floatable ball 40 which will not be tightly sealing off the aperture 44, through the interior chamber 36 and out through the channel 74. If a user wishes to place additional vacuum on the pressure container carrying fluid F, and some fluid F inadvertently enters the interior chamber 36, the floatable ball 40 will float upwardly on the rising fluid F level, pass through the opening 38 in the ring 34, and seal off the hole 68 in the upper seat 66 (not shown). This feature will prevent any fluid F from being drawn into the vacuum generator 80 and expelled into the environment. As a practical matter, however, as the free space above the rising fluid level F in the pressure cylinder 12 decreases, its pressure increases, and its ability to draw in additional fluid slows. This slowing provides feedback to the operator, and helps to prevent the pressure cylinder from being overfilled with fluid.

The device 10 thus provides an inexpensive, simple, easy to operate and a reliable tool is highly useful to quickly prepare pressure cylinders 12 for use in collecting fluids.

The drawings and the foregoing description are not intended to represent the only form of the invention in regard to the details of its construction and manner of operation. In fact, it will be evident to one skilled in the art that modifications and variations may be made without departing from the spirit and scope of the invention. Changes in form and in the proportion of parts, as well as the substitution of equivalents, are contemplated as circumstances may suggest or render expedient; and although specific terms have been employed, they are intended in a generic and descriptive sense only and not for the purpose of limitation, the scope of the invention being delineated in the following claims:

I claim:

1. A device to empty fluid from a sealed pressure container by use of pressurized air, and to thereafter place the container under vacuum, said device comprising:

a sleeve portion with an upper end and lower end, an interior chamber located therein, a ring portion extending into said interior chamber and defining a seating surface at a lower side thereof, said ring portion having a hole formed therethrough;

a slidable seat means with an aperture formed therethrough, said seat means being located in said interior chamber below said ring portion and sized to loosely fit in said interior chamber and adapted to seat on said ring portion;

an upper cap means with a longitudinal air channel formed therethrough located at said upper end of said sleeve portion;

a lower cap means with a longitudinal air channel formed therethrough placed at said lower end of said sleeve portion;

a spring means placed in said interior chamber between said lower cap means and said slidable seat means, said spring means tending to bias said slidable seat means into contact with said ring portion;

a floatable ball located above said slidable seat means and adapted to fluid tightly seat on and seal off its aperture, said floatable ball being sized to freely pass through said hole in said ring portion; and a vacuum generating means comprising a flow-through channel, a junction air channel in communication with said flow-through channel at an upper end and in communication with said channel in said upper cap means, and an air flow valve with opened and closed positions located downstream of said junction air channel.

2. The device of claim 1, wherein said upper and lower ends of said sleeve portions are female threaded and said upper and lower cap means are male threaded and are adapted to screw together.

3. The device of claim 1, wherein said interior chamber is generally cylindrical and said slidable seat has a smaller diameter than an interior diameter of said interior chamber below said ring portion.

4. The device of claim 1, further comprising a dry break hydraulic fitting positioned below said lower cap means, and adapted to permit said device to be detachably attached to the pressure cylinder to be evacuated of fluid and placed under vacuum.

5. The device of claim 1, further comprising a seat portion with an opening formed therethrough, positioned below said upper cap means, said ball being adapted to seal off said opening in said seat means when said ball is brought into contact therewith.

6. The device of claim 1, wherein a window is formed in said sleeve portion and said device further comprises a transparent tube which is placed in said interior chamber above said ring portion, and which is fluid tightly retained in place by said upper cap portion.

7. The device of claim 1, wherein the floatable ball is a hollow aluminum ball.

* * * * *